US006967544B2

(12) United States Patent
Ji

(10) Patent No.: US 6,967,544 B2
(45) Date of Patent: Nov. 22, 2005

(54) MINIATURE LTCC 2-WAY POWER SPLITTER

(75) Inventor: Daxiong Ji, Brooklyn, NY (US)

(73) Assignee: Scientific Components, Brooklyn, NY (US)

( * ) Notice: Subject to any disclaimer, the term of this patent is extended or adjusted under 35 U.S.C. 154(b) by 202 days.

(21) Appl. No.: 10/609,353

(22) Filed: Jun. 30, 2003

(65) Prior Publication Data

US 2004/0263283 A1 Dec. 30, 2004

(51) Int. Cl.[7] ..... H01P 5/12
(52) U.S. Cl. ..... 333/136; 333/175; 333/185
(58) Field of Search ..... 333/136, 175, 333/181, 184, 185

(56) References Cited

U.S. PATENT DOCUMENTS 6,114,925 A * 9/2000 Lo ..... 333/185
6,329,890 B1 * 12/2001 Brooks et al. ..... 333/204
6,525,623 B2 * 2/2003 Sridharan et al. ..... 333/128
6,819,202 B2 * 11/2004 Ralph ..... 333/125

* cited by examiner

*Primary Examiner*—Vibol Tan
(74) *Attorney, Agent, or Firm*—Kevin Redmond

(57) ABSTRACT

A power splitter has a small size with good electrical performance. The power splitter includes a substrate with several dielectric layers. A capacitor is formed between two of the dielectric layers. A pair of inductors are formed by circuit lines located on the dielectric layers. Several terminals are located on outer surfaces of the substrate. Conductive vias extend between the layers in order to provide an electrical connection between the capacitor, the inductors and the terminals. The substrate is formed from layers of low temperature co-fired ceramic. The circuit lines have a curving or sinuous shape on the dielectric layers. The inductors are electromagnetically coupled. The power splitter has a compact overall size.

20 Claims, 8 Drawing Sheets

ELECTRICAL SPECIFICATIONS

| POWER SPLITTER MODEL | FREQUENCY (MHz) | INSERTION LOSS (dB) ABOVE 3.0 dB | | ISOLATION (dB) | | PHASE UNBALANCE (Degrees) | | AMPLITUDE UNBALANCE (dB) | | RETURN LOSS (dB) | |
|---|---|---|---|---|---|---|---|---|---|---|---|
| | | TYP. | MAX. | TYP. | MAX. | TYP. | MAX. | TYP. | MAX. | INPUT TYP. | OUTPUT MAX. |
| 1 | 800–1175 | 0.5 | 0.8 | 20 | 15 | 1.0 | 3 | 0.1 | 0.3 | 16 | 18 |
| | 875–1125 | 0.5 | 0.9 | 22 | 18 | 1.0 | 3 | 0.1 | 0.3 | 16 | 20 |
| 2 | 1100–1450 | 0.5 | 0.8 | 23 | 17 | 1.5 | 3 | 0.25 | 0.4 | 15 | 17.5 |
| | 1200–1375 | 0.4 | 0.7 | 25 | 20 | 1.5 | 3 | 0.2 | 0.3 | 16 | 18 |
| 3 | 1425–1900 | 0.5 | 0.9 | 23 | 17 | 2.5 | 4 | 0.25 | 0.4 | 15 | 18 |
| | 1550–1800 | 0.5 | 0.9 | 25 | 20 | 2.0 | 4 | 0.2 | 0.4 | 19 | 18 |
| 4 | 1850–2200 | 0.5 | 0.9 | 22 | 17 | 2.0 | 5 | 0.25 | 0.4 | 16 | 19 |
| | 1900–2100 | 0.5 | 0.9 | 24 | 20 | 2.0 | 5 | 0.2 | 0.4 | 16 | 19 |
| 5 | 2225–2700 | 0.5 | 1.1 | 21 | 17 | 3.5 | 6 | 0.6 | 0.8 | 19 | 17 |
| | 2325–2600 | 0.4 | 1.0 | 23 | 20 | 2.5 | 6 | 0.4 | 0.7 | 20 | 17 |

*Fig. 11*

MINIATURE LTCC 2-WAY POWER SPLITTER

BACKGROUND

1. Field of the Invention

This invention relates to power splitters in general and more particularly to a power splitter having a small package size.

2. Description of Related Art

Power splitters have been made by forming transmission lines on microstrip structures using printed circuit boards. Power splitters have also been fabricated on ceramic substrates using screened on thick film conductors and dielectrics. In some applications, printed circuit board space is extremely limited with additional space just not available. It is desirable that the splitter be as small as possible while still having the proper impedance and not having excessive cross-talk noise. Printed circuit boards have a problem in power splitter applications in that the desired transmission line impedance can be hard to achieve in a small package size due to the low dielectric constant of the printed circuit board material. Ceramic materials have a higher dielectric constant and can achieve the same impedance transmission lines in a smaller size. Unfortunately, using a thick film process to fabricate a multilayered structure is difficult to manufacture on a repeatable and cost effective basis. Further, if the circuit lines are placed to close to each other in the ceramic package, excessive cross-talk noise can result.

Power splitters have also been made using balun transformers. The transformer is difficult to repeatedly produce. Variations in tightness of the windings, magnet wire twist rate and permeability/permissivity of the ferrite material cause the transformer electrical parameters to shift and vary. Transformers are large and require excessive amounts of space on a printed circuit board. Transformers are difficult to assemble to a circuit board requiring a lengthy manual assembly process by a skilled operator. This adds undesirable cost to the product and is difficult for large scale manufacturing.

While power splitters have been used, they have suffered from taking up excessive space, being difficult to manufacture and expensive. A current unmet need exists for a power splitter that is smaller with good electrical performance, that can be repeatably manufactured and that is low in cost.

SUMMARY

It is a feature of the invention to provide a power splitter that has a small size with good electrical performance.

Another feature of the invention is to provide a power splitter that includes a substrate with several dielectric layers. A capacitor is formed between two of the dielectric layers. A pair of inductors are formed by circuit lines located on the dielectric layers. Several terminals are located on outer surfaces of the substrate. Conductive vias extend between the layers in order to provide an electrical connection between the capacitor, the inductors and the terminals. The substrate is formed from layers of low temperature co-fired ceramic. The circuit lines have a sinuous shape on the dielectric layers. The inductors are electromagnetically coupled.

BRIEF DESCRIPTION OF THE DRAWINGS

FIG. 11 is a table of electrical parameters for several power splitters for different frequencies built in accordance with the present invention.

It is noted that the drawings of the invention are not to scale. In the drawings, like numbering represents like elements between the drawings.

DETAILED DESCRIPTION

Figure 1:
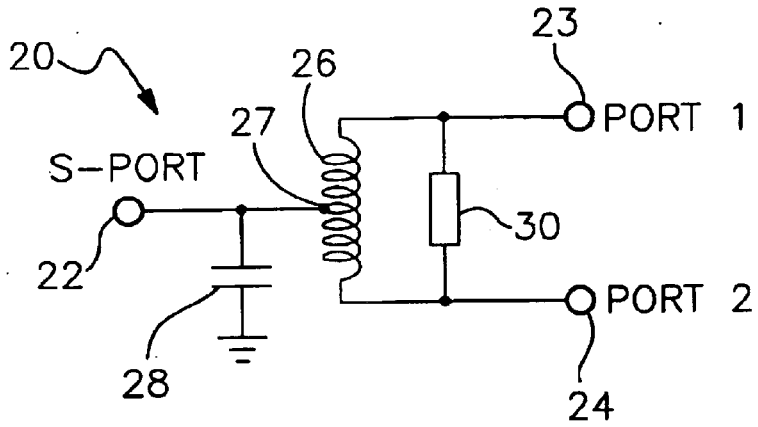
Fig. 1 (Prior Art)
FIG. 1 is a schematic drawing of a conventional 2-way zero degree power splitter.

FIG. 1 shows a schematic drawing of a conventional 2-way zero degree power splitter. Power splitter 20 has an S port or input port 22, a transformer 26 with center tap 27, a capacitor 28, a resistor 30 and a pair of output ports 23 and 24. The center tap of the transformer connects to the input port 22. The transformer 26 provides a matching impedance. Capacitor 28 improves VSWR at the input port 22 and improves isolation between the output ports 23 and 24. Resistor 30 improves isolation between the output ports 23 and 24. Power splitter 20 is a 2 way power splitter since the input signal is split into two output signals.

Figure 2:
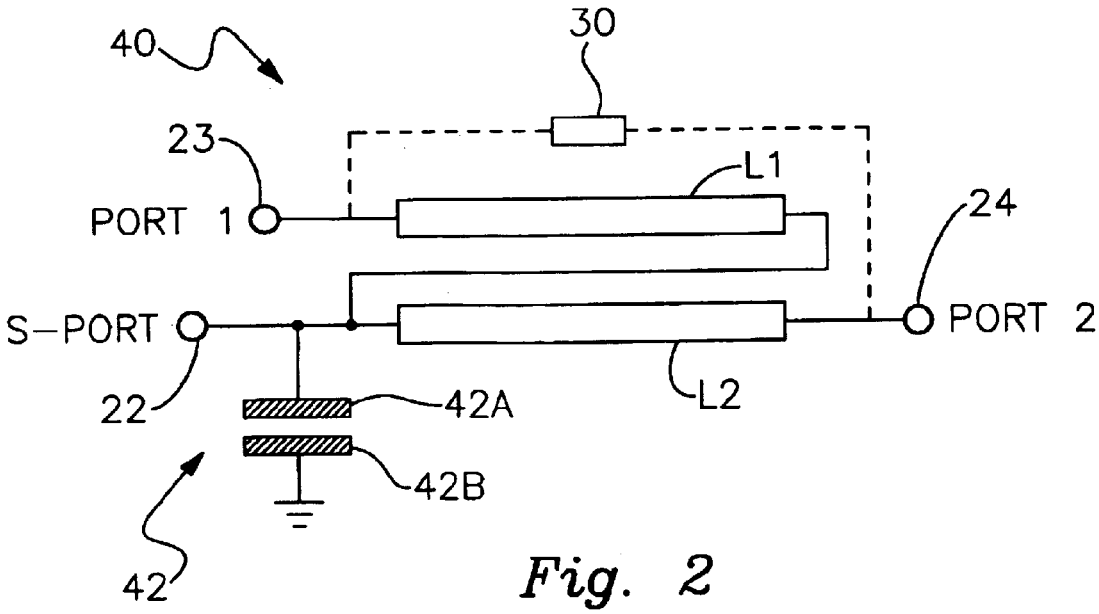
FIG. 2 is a schematic drawing of a miniature 2-way zero degree power splitter in accordance with the present invention.
Figure 3:
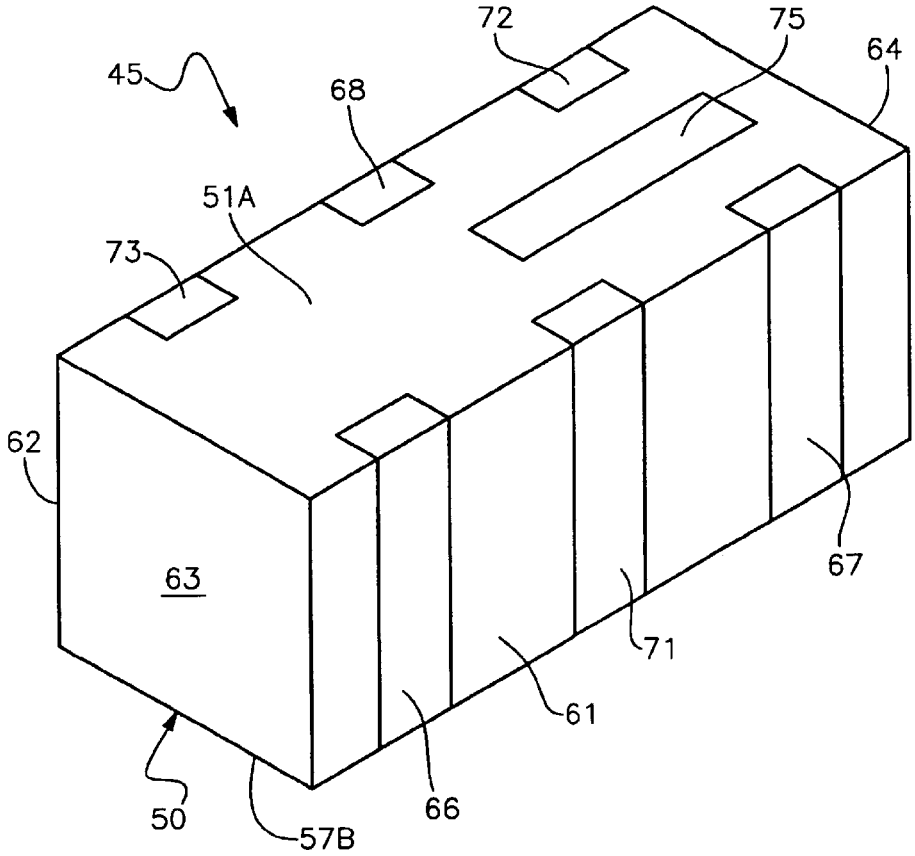
FIG. 3 is a perspective view of a miniature 2-way zero degree power splitter in accordance with the present invention.
Figure 4:
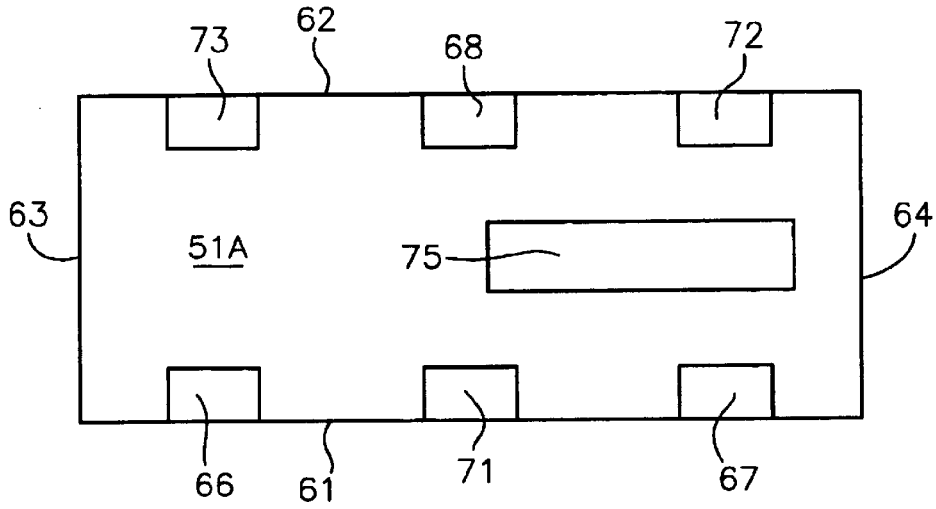
FIG. 4 is a top view of a FIG. 3.
Figure 5:
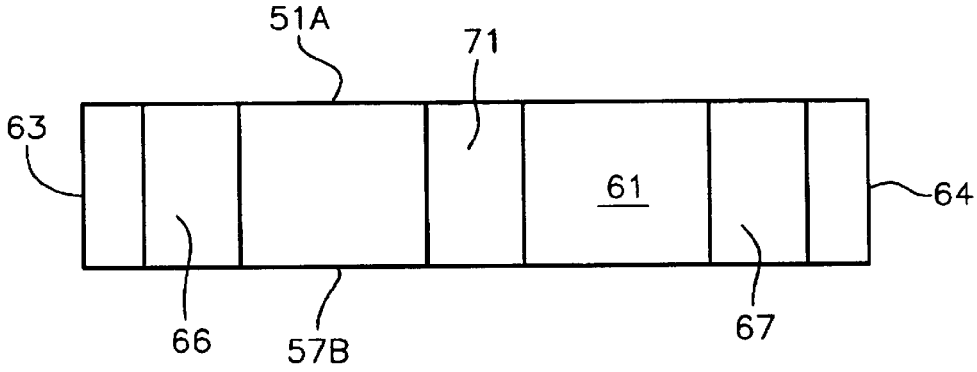
FIG. 5 is a side view of FIG. 3.
Figure 6:
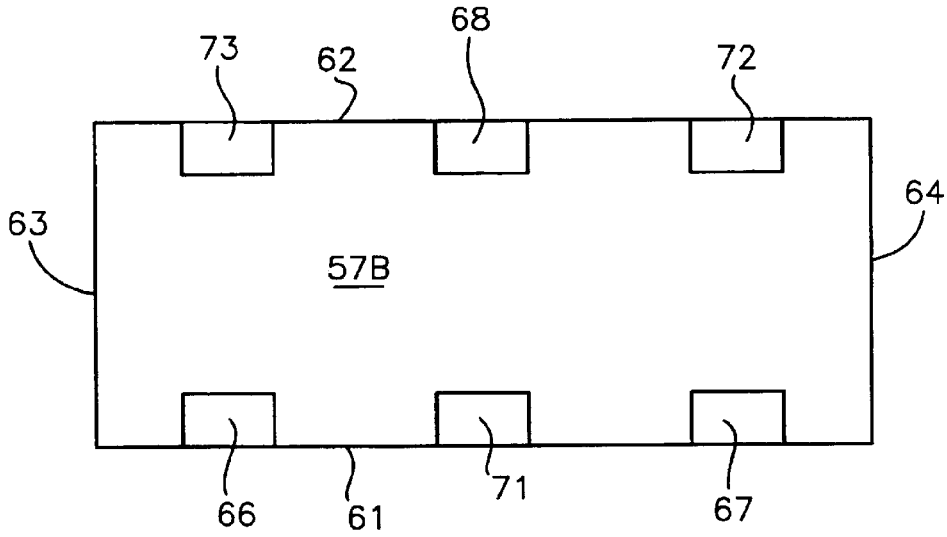
FIG. 6 is a bottom view of a FIG. 3.
Figure 7:
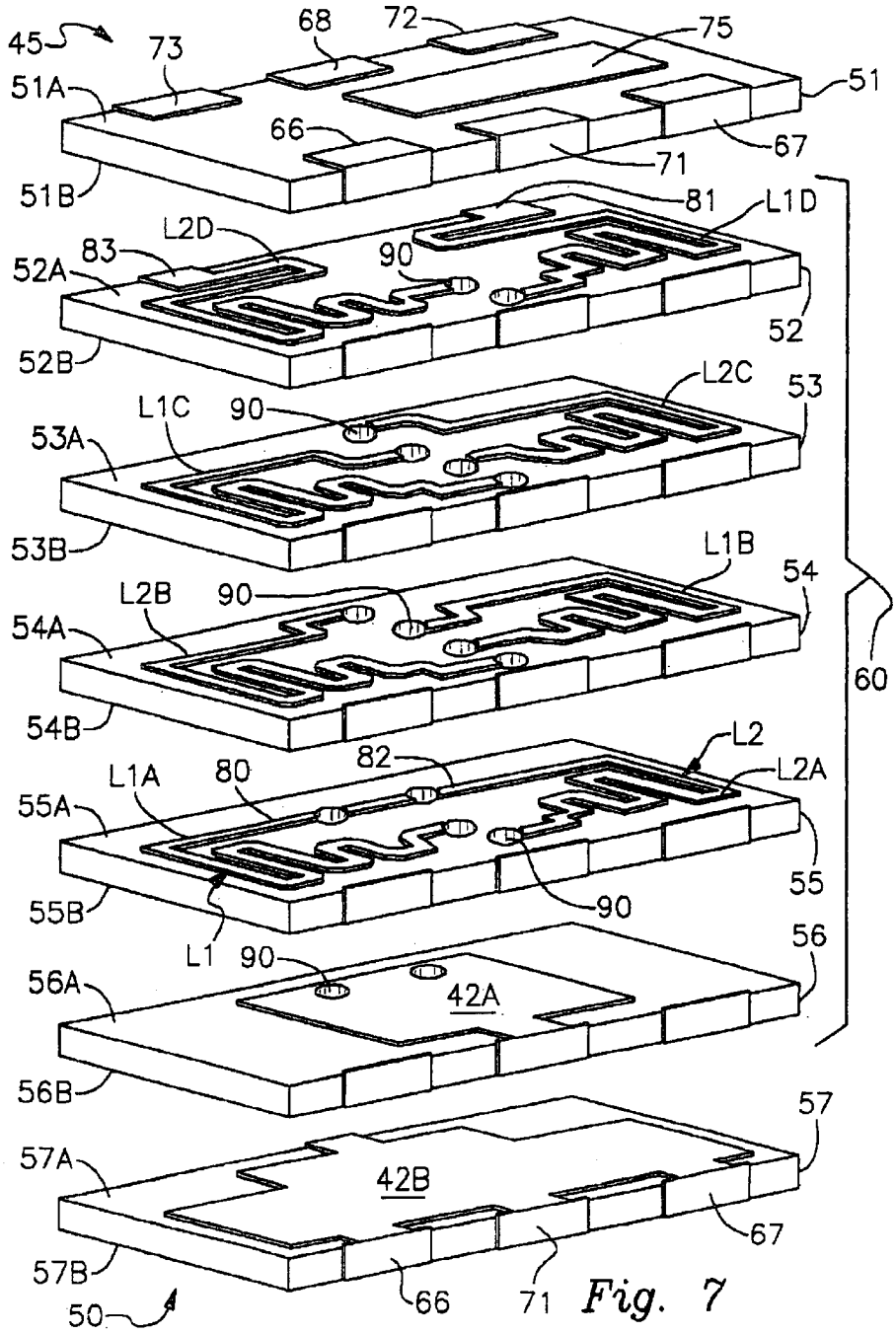
FIG. 7 is an exploded perspective view of FIG. 3 showing the inner layers.

FIG. 2 shows a schematic drawing of a miniature 2-way zero degree power splitter in accordance with the present invention. Power splitter 40 has an S port or input port 22, an inductor L1, an inductor L2, a capacitor 42 with plates 42A and 42B, a resistor 30 and a pair of output ports 23 and 24. The junction of inductors L1 and L2 connects to the input port 22. The inductors L1 and L2 provide a matching impedance. Capacitor 42 improves VSWR at the input port 22 and improves isolation between the output ports 23 and 24. Resistor 30 improves isolation between the output ports 23 and 24. Power splitter 40 is a 2 way power splitter since the input signal is split into two output signals.

Referring to FIGS. 3–7, the power splitter 40 shown in the schematic of FIG. 2 is realized in a physical package. Power splitter 45 has a multi-layered dielectric substrate or block 50 formed from layers of low temperature co-fired ceramic (LTCC) material. Substrate 50 is comprised of multiple layers of LTCC material. There are seven LTCC layers in total. Block 50 has six outer surfaces including a top surface 51A, bottom surface 57B and six side surfaces 61, 62, 63 and 64. Top and bottom surfaces 51A and 57B are substantially parallel and located on opposing sides of substrate 50. Similarly, sides 61 and 62 are parallel, as are sides 63 and 64.

Several conductive terminals are located on substrate 50. The terminals are located on side surfaces 61 and 62 and wrap around and extend onto the adjacent top surface 51A and bottom surfaces 57B. The terminals are formed from a solderable metal. Ground terminal 66 and 67 are located on side surface 61 and wrap around onto the top and bottom surfaces. Ground terminal 68 is located on side surface 62 and wraps around onto the top and bottom surfaces. The ground terminals would be soldered to a source of ground potential. Input port terminal 71 is located on side surface 61 and wraps around onto the top and bottom surfaces. Input port terminal 71 corresponds to input port 22 of FIG. 2. Output port terminal 72 is located on side surface 62 and wraps around onto the top and bottom surfaces. Output port terminal 72 corresponds to output port 23 of FIG. 2.

Output port terminal 73 is located on side surface 62 and wraps around onto the top and bottom surfaces. Output port terminal 73 corresponds to output port 24 of FIG. 2. The terminals are used to electrically connect the power splitter to an external electronic circuit. The portions of the terminals on bottom surface 57B would typically be soldered to a printed circuit board. An orientation mark 75 is placed on top surface 51A in order to prevent the power splitter from being installed incorrectly.

Planar layers 51, 52, 53, 54, 55, 56 and 57 are all stacked on top of each other and form a unitary structure 50 after firing in an oven. Layer 51 is the top layer, layer 57 is the bottom layer and layers 52, 53, 54, 55 and 56 form inner layers 60. Layers 51–57 are commercially available in the form of an unfired tape. Each of the layers has a top surface 51A, 52A, 53A, 54A, 55A, 56A and 57A. Similarly, each of the layers has a bottom surface 51B, 52B, 53B, 54B, 55B, 56B and 57B. The layers have several circuit features that are patterned on the surfaces. Multiple vias 90 extend through each of the layers. Vias 90 are formed from an electrically conductive material and electrically connect the circuit features on one layer to the circuit features on another layer.

A pair of inductors L1 and L2 are formed on layers 52, 53, 54 and 55. Inductor L1 has an end 81 on layer 52 and an end 80 on layer 55. Inductor L1 has windings L1A, L1B, L1C and L1D. Inductor L2 has an end 83 on layer 52 and an end 82 on layer 55. Inductor L2 has windings L2A, L2B, L2C and L2D. A capacitor 42 is formed on layers 56 and 57. It is noted that inductor ends 80 and 82 are connected on layer 55.

Layer 51 has several circuit features that are patterned on surface 51A. Surface 51A has terminals 66, 67, 68, 71, 72 and 73. Layer 52 has several circuit features that are patterned on surface 52A. Circuit lines or windings L1D and L2D are patterned on surface 52A. Similarly, layer 53 has windings or circuit lines L1C and L2C patterned on surface 53A. Layer 54 has windings or circuit lines L1B and L2B patterned on surface 54A. Layer 55 has windings or circuit lines L1A and L2A patterned on surface 55A. The windings of inductors L1 and L2 are shaped as a snake like or sinuous or circuitous path on the top surfaces of layers 52–55. The windings or circuit lines are formed from a conductive metal material. The windings of inductor L1 (L1A, L1B, L1C, L1D) are electromagnetically coupled to the respective adjacent windings of inductor L2 (L2A, L2B, L2C, L2D) through the ceramic dielectric layers.

The windings are connected between layers by respective vias 90. Winding or circuit line L1A is connected to winding L1B by a via 90. Winding or circuit line L1B is connected to winding L1C by a via 90. Winding or circuit line L1C is connected to winding L1D by a via 90. Similarly, winding or circuit line L2A is connected to winding L2B by a via 90. Winding or circuit line L2B is connected to winding L2C by a via 90. Winding or circuit line L2C is connected to winding L2D by a via 90.

Inductor end 83 is connected to output terminal 73 on layer 52. Inductor end 81 is connected to output terminal 72 on layer 52.

A capacitor 42 is formed on layers 56 and 57. A metal plate 42A is located on surface 56A. Metal plate 42B is located on surface 57A. Capacitor 42 is formed by plates 42A and 42B and the dielectric layer 56 in between the plates. Plate 42A is connected to terminal 71 or the input port. Plate 42B is connected to ground terminals 66, 67 and 68.

The circuit features such as the vias, circuit lines, terminals and plates are formed by screening a thick film paste material and firing in an oven. This process is well known in the art. First, layers of low temperature co-fired ceramic have via holes punched, the vias are then filled with a conductive material. Next, the circuit features are screened onto the layers. The terminals, lines and plates are formed with a conductive material. The layers are then aligned and stacked on top of each other to form substrate 50. The substrate 50 is then fired in an oven at approximately 900 degrees centigrade to form a single unitary block.

A version of power splitter 45 was designed, fabricated and tested for electrical performance in the frequency range of 800 to 1200 Mhz. The splitter had an overall substrate 50 size of 0.126 inches by 0.063 inches by 0.035 inches. The splitter was tested with an external 100 ohm resistor connected between ports 23 and 24. Power splitter 45 can handle power levels up to 20 watts and is insensitive to electro-static discharges.

Figure 9:
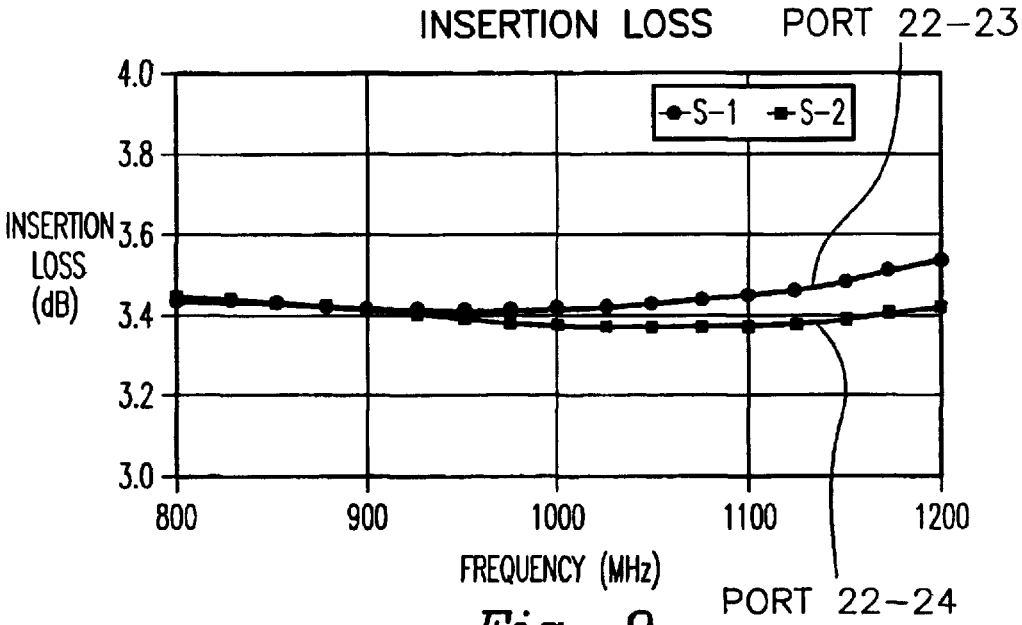
FIG. 9 is a graph of isolation versus frequency for the power splitter of FIG. 3.
Figure 8:
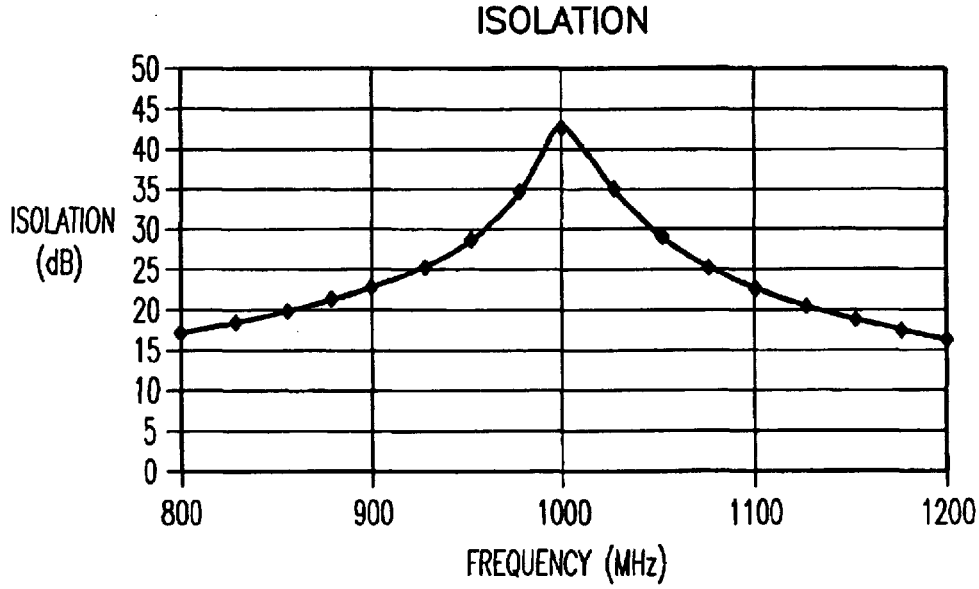
FIG. 8 is a graph of insertion loss versus frequency for the power splitter of FIG. 3.
Figure 10:
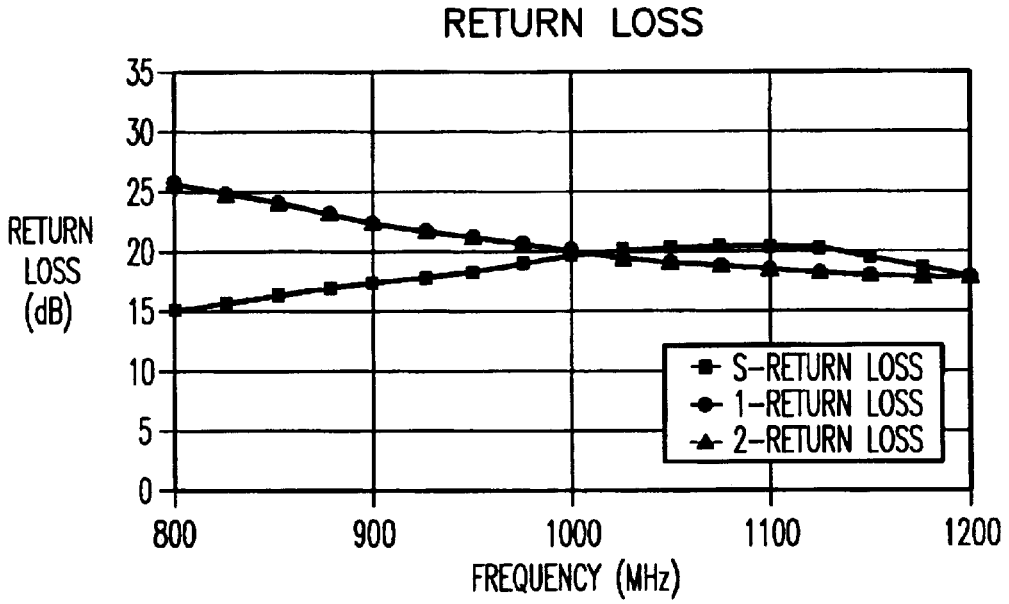
FIG. 10 is a graph of return loss versus frequency for the power splitter of FIG. 3.

Turning now to FIG. 8, a graph of insertion loss versus frequency for the fabricated power splitter is shown. FIG. 8 shows low insertion loss. FIG. 9 shows a graph of isolation versus frequency for power splitter 45. Power splitter 45 has high isolation. FIG. 10 is a graph of return loss versus frequency for power splitter 45. The power splitter has good return loss at the input and output ports.

FIG. 11 is a table of electrical parameters for several power splitters for different frequencies built in accordance with the present invention. Five different versions of power splitter 45 were designed to cover the frequency range of 800–2700 MHz. The power splitters of FIG. 11 exhibit low amplitude and phase unbalance.

Power splitter 45 can be used to make 4-way and 8-way splitters as well as higher order splitters. Since power splitter 20 is a 2-way power splitter, the 2-way splitter is cascaded to form 4-way and 8-way power splitters. Multiple power splitters 45 would be mounted side by side on a printed circuit board. Although this technique is well known there are several advantages of cascading power splitter 45. First, the small size of power splitter 45 makes cascading practical because the higher order splitter is still very small. It is still possible to fit multiple splitters 45 used in 4 & 8-way splitters in a small space. Second, using the same 2-way splitter repeatedly in high volume reduces cost because the same splitter parts can be bought in large volume and at reduced cost.

The present invention has several advantages. Since, the inductors L1 and L2 are integrated into substrate 50 on layers 52–56, they take up less space, resulting in a smaller package that is easier to assemble and to automate production of. This provides a savings of space on the printed circuit board and allows for a faster assembly process at lower cost. In addition, repeatability of electrical performance is of prime concern. Fabricating the power splitter using a low temperature co-fired ceramic process results in more uniform electrical performance in the resulting splitter.

The low temperature co-fired ceramic layers have tightly controlled tolerances that provide well defined electromagnetic characteristics. Miniature power splitter 45 is small in size, high in performance, has high isolation, low insertion loss, handles a range of frequencies, needs few manufacturing steps and is low in cost providing an improvement over previous power splitters.

While the invention has been taught with specific reference to these embodiments, someone skilled in the art will recognize that changes can be made in form and detail without departing from the spirit and the scope of the invention. The described embodiments are to be considered in all respects only as illustrative and not restrictive. The scope of the invention is, therefore, indicated by the appended claims rather than by the description. All changes that come within the meaning and range of equivalency of the claims are to be embraced within their scope.

What is claimed is:

1. A power splitter comprising:

a) a substrate having a plurality of dielectric layers;

b) a capacitor formed between two of the layers;

c) a first inductor formed by a first circuit line formed on a plurality of the layers;

d) a second inductor formed by a second circuit line formed on a plurality of the layers;

e) a plurality of terminals located on an outer surface of the substrate; and f) a plurality of conductive vias extending between the layers for providing an electrical connection between the capacitor, the first circuit lines, the second circuit lines and the terminals.

2. The power splitter according to claim 1, wherein the substrate is formed from layers of low temperature co-fired ceramic.

3. The power splitter according to claim 1, wherein the circuit lines have a sinuous shape.

4. The power splitter according to claim 1, wherein an external resistor is connected between two of the terminals.

5. The power splitter according to claim 1, wherein the capacitor further comprises, a first plate located on a first dielectric layer and a second plate formed on a second dielectric layer.

6. A power splitter having an input port and a first and second output port comprising:

a) a multi-layered dielectric ceramic substrate, the substrate having a first and a second outer surface, the input port and the first and second output ports located on the second outer surface;

b) a capacitor located within the substrate and connected to the input port;

c) a first inductor located within the substrate and having a first and second end, the first end connected to the second output port;

d) a second inductor located within the substrate and having a third and fourth end, the third end connected to the first output port and the fourth end connected to the second end; and e) a plurality of conductive vias extending through the substrate between the first and second outer surfaces, the vias providing electrical connections within the substrate between the inductors, the capacitor and the ports.

7. The power splitter according to claim 6, wherein the substrate is formed from layers of low temperature co-fired ceramic.

8. The power splitter according to claim 7, wherein the inductors are formed from circuit lines located on the layers.

9. The power splitter according to claim 8, wherein the circuit lines are formed on more than one layer and interconnected by the vias.

10. The power splitter according to claim 8, wherein the circuit lines have a sinuous shape.

11. The power splitter according to claim 10, wherein the first and second inductors are electromagnetically coupled to each other.

12. The power splitter according to claim 11, wherein an external resistor is connected between the first and second output ports.

13. The power splitter according to claim 6, wherein the capacitor further comprises, a first plate located on a first dielectric layer and a second plate located on a second dielectric layer.

14. A power splitter having an input port and a first and second output port comprising:

a) a multi-layered low temperature co-fired ceramic substrate, the substrate having first, second, third, fourth, fifth, sixth and seventh layers, each layer having a top and bottom surface;

b) a first circuit line located on the first, second, third and fourth layers and having a first end and a second end, the first end connected to the input port and the second end connected to the first output port;

c) a first set of vias electrically connecting the first circuit line on the first, second third and fourth layers to form a first inductor;

d) a second circuit line located on the first, second, third and fourth layers and having a first end and a second end, the first end connected to the input port and the second end connected to the first output port;

e) a second set of vias electrically connecting the second circuit line on the first, second third and fourth layers to form a second inductor; and f) a capacitor formed between the sixth and seventh layers and connected to the input port.

15. The power splitter according to claim 14, wherein the circuit lines have a sinuous shape on each layer.

16. The power splitter according to claim 14, wherein the first and second inductors are electromagnetically coupled to each other.

17. The power splitter according to claim 14, wherein an external resistor is connected between the first and second output ports.

18. The power splitter according to claim 14, wherein the capacitor further comprises, a first plate located on the sixth layer and a second plate located on the seventh layer.

19. The power splitter according to claim 14, wherein the ports are formed by terminals located on an outer surface of the substrate.

20. The power splitter according to claim 19, wherein the terminals wrap around the substrate onto an adjacent outer surface.

* * * * *